US006843087B2

(12) United States Patent
Prince et al.

(10) Patent No.: US 6,843,087 B2
(45) Date of Patent: Jan. 18, 2005

(54) COLD ROLLING PROCESS FOR ROLLING HARD METAL OR METAL ALLOYS

(75) Inventors: Francis Prince, Le Havre (FR); Jean-Yves Henri Claire, Courdimanche (FR)

(73) Assignee: Mobil Oil Francaise, Courbevoie (FR)

( * ) Notice: Subject to any disclaimer, the term of this patent is extended or adjusted under 35 U.S.C. 154(b) by 61 days.

(21) Appl. No.: 10/182,492

(22) PCT Filed: Feb. 7, 2001

(86) PCT No.: PCT/EP01/01380

§ 371 (c)(1),
(2), (4) Date: Nov. 12, 2002

(87) PCT Pub. No.: WO01/59039

PCT Pub. Date: Aug. 16, 2001

(65) Prior Publication Data

US 2003/0115921 A1 Jun. 26, 2003

(30) Foreign Application Priority Data

Feb. 8, 2000 (EP) ..... 00400349

(51) Int. Cl.[7] ..... B21B 45/02
(52) U.S. Cl. ..... 72/42
(58) Field of Search ..... 72/42

(56) References Cited

U.S. PATENT DOCUMENTS

| | | | | | |
|---|---|---|---|---|---|
| 4,636,323 | A | * | 1/1987 | Makino et al. | 508/195 |
| 4,803,000 | A | * | 2/1989 | Uematsu et al. | 508/431 |
| 5,001,013 | A | * | 3/1991 | Sturwold et al. | 428/467 |
| 5,021,172 | A | * | 6/1991 | Kavnatsky et al. | 508/318 |
| 6,245,723 | B1 | * | 6/2001 | Sigg et al. | 508/315 |

* cited by examiner

*Primary Examiner*—Lowell A. Larson
(74) *Attorney, Agent, or Firm*—Joseph J. Dvorak

(57) ABSTRACT

The present invention relates to a cold rolling process for rolling hard metal or metal alloys, comprising applying an effective amount of an oil composition comprising a base stock oil and, based on the total weight of the composition, from 1 to 80% by weight of di(2-ethylhexyl)adipate. Example of hard base metals include steel and nickel.

13 Claims, 2 Drawing Sheets

COLD ROLLING PROCESS FOR ROLLING HARD METAL OR METAL ALLOYS

The present invention relates to a cold rolling process for rolling hard metal or metal alloys.

The stainless steel rolling industry expresses the need to maximize the efficiency of their rolled metal manufacturing process. In general terms, this means that they wish to operate at higher rolling speeds and to produce more marketable products per operating shift. Additionally, they also wish to minimize the number of passes through the mill taken to achieve a given level of reduction. Both these routes require that quality and surface finish be not compromised. Also, there is a wish to roll harder materials, such as special steels (e.g. molybdenum steel) and/or allow higher reduction ratios.

The invention thus provides a cold rolling process for for high-speed cold rolling mills that affords the following customer benefits:

- lower rolling and reduced mill power (this allowing rolling harder material and/or allow higher reduction ratios);
- allow one or two pass(es) reduction versus conventional oil lubrication;
- improved rolled surface finish (especially on ferritic and austenitic steels), e.g. brightness improvement.

The invention is effective on any type of cold rolling, be it reversible or not, of the Sendzimir type (e.g. 1-2, 1-2-3, 1-2-3-4), or of Z-high type (e.g. 2-high, 4-high, 6-high), be it a reversible mill, a tandem mill, etc.

Especially, the invention exhibits high reduction and rolling capabilities while providing an excellent strip surface finish when rolling at high speed. The invention is also suited to Z-high rolling mill technology where high reduction ratio at low speed is obtained.

Masuda et al, in "Effect of rolling oil additives on Heat Scratch generation—a study on rolling oils for cold rolling of stainless steels", Journal of the JSTP, vol.28, No. 316 (1987-5) discloses an oil composition comprising various esters, which are selected from the group consisting in 2-ethylhexyl stearate, di(2-ethylhexyl) phthalate, trimethylolpropane caprate, dimer-acid methyl ester and lard methyl ester.

The prior art does not teach or even suggest the instant invention.

Thus, the invention provides a cold rolling process for rolling hard metal or metal alloys, comprising applying an effective amount of an oil composition comprising a base stock oil and, based on the total weight of the composition, from 1 to 80%, preferably from 1 to 30% by weight, of di(2-ethylhexyl)adipate.

According to one embodiment, the hard metal or metal alloys are selected in the group consisting of steel and stainless steel. The steels and stainless steels to which the invention applies are any steel, including very hard steels.

According to a further embodiment the hard metal is a non-ferrous metal, like nickel or lead.

According to a further embodiment, the hard metal or metal alloys are selected from nickel and Invar®, which is a trademark of Imply SA for nickel-iron alloys.

According to a further embodiment, the oil composition further comprises an alkyl alkylate ester, in which the alkyl comprises 2 to 8 carbon atoms and the alkylate comprises 14 to 24 carbon atoms, preferably n-butyl, iso-butyl, or tert-butyl stearate, and where the weight ratio di(2-ethylhexyl) adipate:alkyl alkylate ester is from 1:1 to 20:1.

According to a further embodiment, wherein the oil composition further comprises a fatty alcohol having from 10 to 20 carbon atoms, preferably from 12 to 18 carbon atoms. Altough the fatty alcohol can be linear or branched, linear alcohols are preferred.

According to a preferred embodiment, the fatty alcohol is lauryl alcohol.

When used with steel or stainless steel, the cold rolling oil composition comprising a base stock oil and, based on the total weight of the composition, from 1 to 80% of di(2-ethylhexyl)adipate, exhibits the following roll force versus % reduction at a roll speed of 300 m/min such as:

$$RF<200R-5900$$

where RF is the Roll Force expressed in tons/m and R is reduction expressed in %, and where RF is >500 tons/m.

When used with steel or stainless steel, the cold rolling oil composition comprising a base stock oil and, based on the total weight of the composition, from 1 to 80% of di(2-ethylhexyl) adipate, exhibits the following roll force versus % reduction at a roll speed of 700 m/min such as:

$$RF<80R-1550$$

where RF is the Roll Force expressed in tons/m and R is reduction expressed in %, and where RF is >400 tons/m.

The invention is now disclosed in more details in the following specification, and in reference to the drawings in which.

Figure 1:
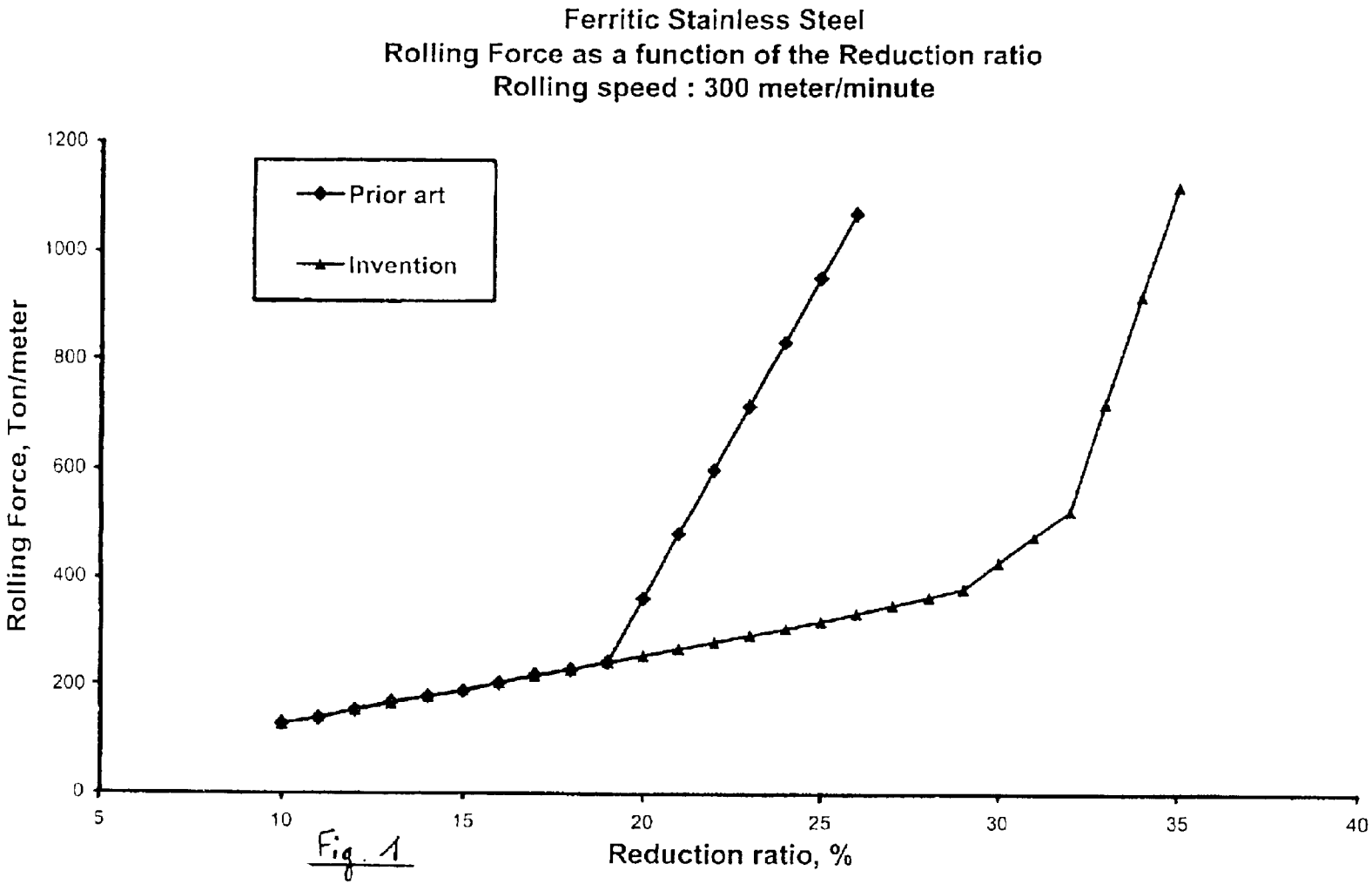
FIG. 1 is a graph showing the rolling force versus the reduction, at 300 m/min, when using a prior art process and the process of the invention, evidencing the influence of the oil composition on reduction capacity.

The applied oil compositions are neat oils.

The base stock oil is any oil typically used in the field of cold rolling. It can be paraffinic or naphthenic, hydrocracked or not.

Paraffinic base oils are made from crude oils that have relatively high alkane contents (high paraffin and isoparaffin contents). Typical crudes are from the Middle East, North Sea, US mid-continent. The manufacturing process requires aromatics removal (usually by solvent extraction) and dewaxing. Paraffinic base oils are characterized by their good viscosity/temperature characteristics, i.e. high viscosity index, adequate low-temperature properties and good stability. They are often referred to as solvent neutrals, where solvent means that the base oil has been solvent-refined and neutral means that the oil is of neutral pH. An alternative designation is high viscosity index (HVI) base oil. They are available in full range of viscosities, from light spindle oils to viscous brightstock.

Naphthenic base oils have a naturally low pour point, are wax-free and have excellent solvent power. Solvent extraction and hydrotreatment can be used to reduce the polycyclic aromatic content.

A preferred base oil is an hydrotreated paraffinic neutral.

The base oil typically has a viscosity from 5 to 40 cSt at 40° C. and preferably from 7 to 16 cSt at 40° C. Viscosity can be adjusted by using a viscosity adjuster (such as kerosene type petroleum cut), if needed.

Preferred base oils are those with compounds having a carbon content between 20 and 25, preferably between 22 and 24.

Also preferred are base oils having an aromatic content equal or smaller than 5% by weight.

The flash point of the base oil is preferably greater than 150° C., and typically is 154° C.

The oil may comprise classical additives, such as surfactants, coupling agents or cosurfactants, friction reducing agents, lubricity agents, corrosion inhibitors or anti-oxidants, extreme-pressure and anti-wear agents, anti-foaming agents, anti-rust agents.

Examples of anti-foaming agents are silicone based, especially polydimethylsiloxane.

Examples of corrosion inhibitors are hindered phenols and zinc dialkyldithiophosphates (ZDDP).

Examples of extreme-pressure and anti-wear agents are dilauryl phosphate, didodecyl phosphite, trialkylphosphate such as tri(2-ethylhexyl)phosphate, tricresylphosphate (TCP), zinc dialkyl(or diaryl)dithiophosphates (ZDDP), phospho-sulphurized fatty oils, zinc dialkyldithiocarbamate), mercaptobenzothiazole, sulphurized fatty oils, sulphurized terpenes, sulphurized oleic acid, alkyl and aryl polysulphides, sulphurized sperm oil, sulphurized mineral oil, sulphur chloride treated fatty oils, chlornaphta xanthate, cetyl chloride, chlorinated paraffinic oils, chlorinated paraffin wax sulphides, chlorinated paraffin wax, and zinc dialkyl(or diaryl)dithiophosphates (ZDDP), tricresylphosphate (TCP), trixylylphosphate (TXP), dilauryl phosphate, respectively.

Examples of corrosion inhibitors or anti-oxidants are radical scavengers such as phenolic antioxidants (sterically hindered), aminic antioxidants, organo-copper salts, hydroperoxides decomposers, butylated hydroxytoluene.

Examples of anti-rust agents are amine derivative of alkenyl succinic anhydride.

Examples of friction reducing agents or lubricity agents are fatty alcohols having a carbon number in the range from 12 to 18, fatty esters having a carbon number in the range from 12 to 18, like glycerol monooleate.

Further elements on base oils and additives can be found in "Chemistry And Technology Of Lubricants", R. M. Mortier and S. T. Orszulik, VCH Publishers, Inc, First published in 1992.

The cold rolling process is the classical process.

The work roll surface does not need to be coated.

The oil temperature is generally maintained at a temperature below 70° C., preferably below 50° C. The process can be carried out on any rolling mill, such as of the Sendzimir type or of the Z-high type, in tandem, etc. The instant oil composition allows a significant reduction of the number of passes. With conventional prior art oils, the number of passes was typically 10. The oil composition of the invention allows lowering this number to 8 passes, which is a significant gain.

The following example illustrate the invention without limiting it. All parts and ratios are given by weight.

EXAMPLE

The following composition is prepared:

TABLE 1

| Ingredients | Content (wt %) |
|---|---|
| Base oil (paraffinic, 9 cSt at 40° C.) | 88.75 |
| Butylated hydroxytoluene | 0.20 |
| tri(2-ethylhexyl)phosphate | 1.00 |
| Amine derivative of alkenyl succinic anhydride | 0.05 |
| di(2-ethylhexyl) adipate | 10.00 |

An oil composition as used in a process of the prior art is also prepared. It comprises the following ingredients:

TABLE 2

| Ingredients | Content (wt %) |
|---|---|
| Base oil (paraffinic, 9 cSt at 40° C.) | 97.40 |
| Butylated hydroxytoluene | 0.10 |
| tri(2-ethylhexyl)phosphate | 0.50 |
| Lauryl alcohol | 1.00 |
| n-butyl stearate ester | 1.00 |

The process of the invention and of the process of the prior art are tested according to the following method.

The test mill is a non-reversing single stand 2-high rolling mill with coiler and decoiler designed for 30 mm wide sheets, which can take up to 0.6 mm thick strips of around 1,000 m length. The rolls have a width of 100 mm and a diameter of 95 mm, and the composition of their steel is ZBSVCD8-3 (which is used for certain Sendzimir mills).

The first run is to evaluate the reduction capacity in one pass, at a constant speed of 300 m/mn. The curve "rolling force" as a function of the reduction rate is recorded when increasing reduction levels. The rolled strip composition is a bright annealed ferritic stainless steel FS30 (Z8 C17, 17% chromium) having a strip thickness of 0.4 mm.

The results of the run are depicted in FIG. 1.

The line of the process of the invention corresponds to the equation

RF=200R−5900, where RF is the Rolling Force expressed in tons/m and R is the reduction expressed in % (where RF is >500 tons/m).

Figure 2:
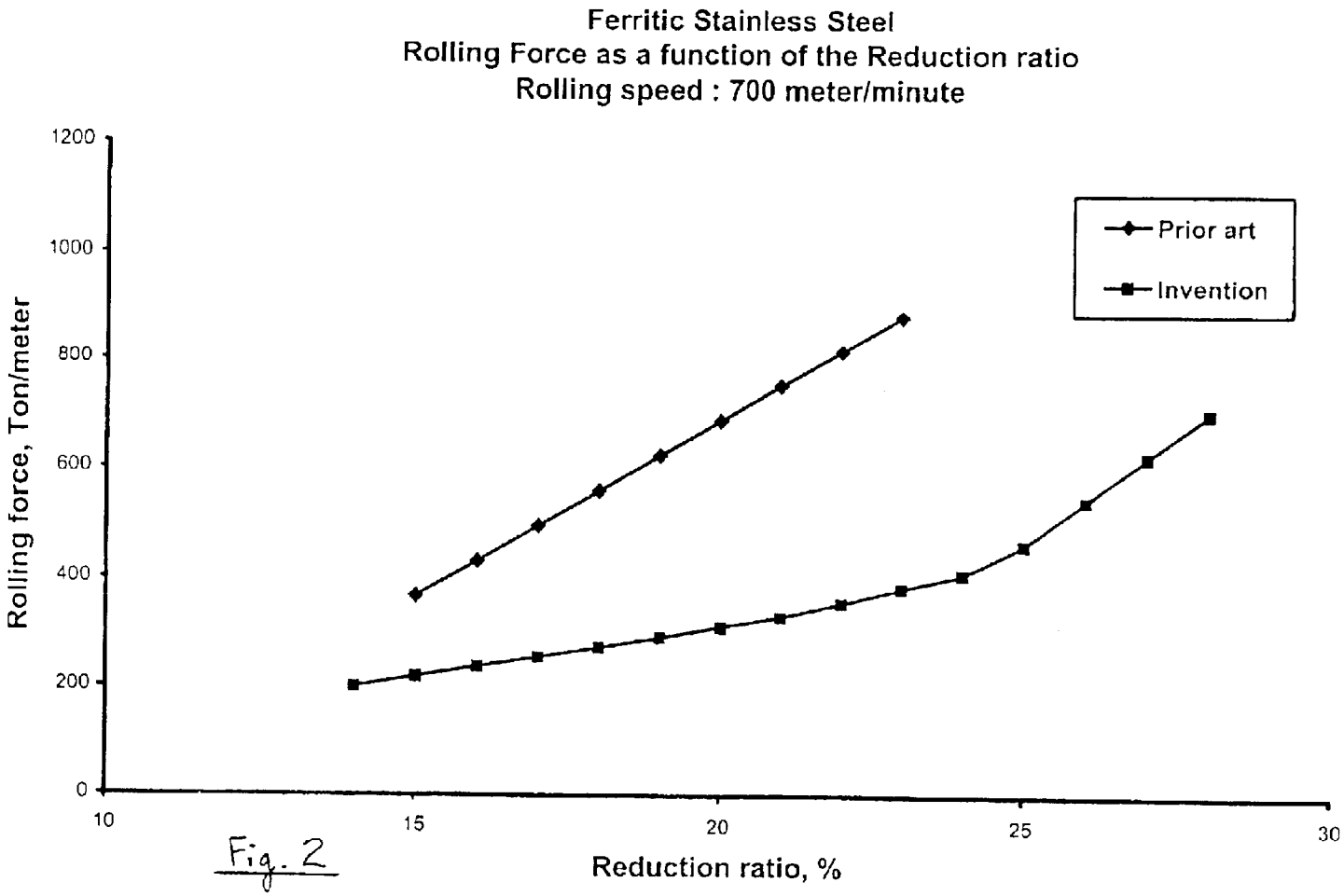
FIG. 2 is a graph showing the rolling force versus the reduction, at 700 m/min, when using a prior art process and the process of the invention, evidencing the influence of the oil composition on reduction capacity.

The second run is to evaluate the reduction capacity in one pass, at a constant speed of 700 m/mn. The results are depicted in FIG. 2, in which a prior art process and the process of the invention are compared. The line of the process of the invention corresponds to the equation RF=80R−1550, where RF is the Rolling Force expressed in tons/m and R is the reduction expressed in % (where RF is >400 tons/m).

The finish of the products has been determined and has been found excellent with the process of the invention.

From the figures it is quite apparent that:

in the process of the invention, at low rolling speed (300 m/mn) , as well as at high rolling speed (700 m/min), the reduction capability is at least equivalent to that of the conventional process; and the higher the reduction rate, the better the results obtained with the process of the invention as compared with results obtained with the process of the prior art.

In addition, the improvement provided by the process of the invention is obtained without impairing the surface finish of the rolled strip.

Additionally, the process of the invention was used to roll pure nickel. The applied oil composition was that of Table 1.

The roll conditions were as follows rolling speed: 300 m/min;

roll width: 15 mm initial thickness: 0.52 mm

With a reduction force of 300 tons/m, the reduction rate was 46%.

In the same conditions, pure nickel was rolled with the oil composition of table 2.

With a reduction force of 300 tons/m, the reduction rate was only 42%.

What is claimed is:

1. In the cold rolling process of hard metal and of hard metal alloys using a rolling oil composition, the improvement comprising using an oil composition comprising a base stock oil and, based on the total weight of the composition, from 1 to 80% by weight of di(2-ethylhexyl)adipate.

2. The improvement according to, claim 1 wherein the oil composition further comprises an alkyl alkylate ester, in which the alkyl comprises 2 to 8 carbon atoms and the alkylate comprises 14 to 24 carbon atoms, and where the weight ratio di(2-ethylhexyl)adipate:alkyl alkylate ester is from 1:1 to 20:1.

3. The improvement according to claim 2, in wherein the alkyl alkylate ester is n-butyl, iso-butyl, or tert-butyl stearate.

4. The improvement according to claim 2, wherein the oil composition further comprises a fatty alcohol having from 10 to 20 carbon atoms, preferably from 12 to 18 carbon atoms.

5. The improvement according to claim 4, wherein the fatty alcohol is lauryl alcohol.

6. The improvement according to claim 2, in which the base stock oil has a viscosity comprised between 5 and 40 cSt at 40° C., and preferably between 7 and 16 cSt at 40° C.

7. The improvement according to claim 6, in which the base stock oil comprises compounds having a carbon content between 20 and 25, preferably between 22 and 24.

8. The improvement according to claim 7, in which the base stock oil has an aromatic content equal or smaller than 5% by weight.

9. The improvement according to claim 8, in which the base stock oil has a flash point greater than 150° C.

10. The improvement according to claim 2, wherein the oil composition comprises, based on the total weight of the composition, from 1 to 30% by weight of di(2-ethylhexyl) adipate.

11. The improvement according to claim 1 of 10, wherein the hard metal or metal alloys are selected in the group consisting of steel and stainless steel.

12. The improvement according to claim 1 or 10, wherein the hard metal is a non-ferrous metal.

13. The improvement according to claim 1 or 10, wherein the hard metal or metal alloys are selected in the group consisting of nickel and nickel-iron alloys.

* * * * *